United States Patent [19]

Berg et al.

[11] 4,092,716

[45] May 30, 1978

[54] CONTROL MEANS AND METHOD FOR CONTROLLING AN OBJECT

[75] Inventors: Robert L. Berg, St. Louis; William J. Murphy, Frontenac, both of Mo.

[73] Assignee: McDonnell Douglas Corporation, St. Louis, Mo.

[21] Appl. No.: 595,130

[22] Filed: Jul. 11, 1975

[51] Int. Cl.[2] ..... G06F 15/50; G06G 7/80

[52] U.S. Cl. ..... 364/424; 244/195; 318/580; 364/434; 364/423

[58] Field of Search ..... 235/150.2, 150.1, 61.5 R, 235/61.5 E, 61.5 S, 61.5 A; 35/10.2; 318/567, 575, 580, 586, 561; 33/233, 238, 239; 244/175, 178, 195; 114/21 R, 21 W, 144 RE, 144 R, 144 E; 364/424, 434, 578, 805, 604

[56] References Cited

U.S. PATENT DOCUMENTS

| | | | |
|---|---|---|---|
| 2,947,982 | 8/1960 | Newell | 235/61.5 |
| 3,037,201 | 5/1962 | Kelley | 235/61.5 |
| 3,057,584 | 10/1962 | Bretol | 244/195 |
| 3,135,053 | 6/1964 | Newman et al. | 235/61.5 |
| 3,260,478 | 7/1966 | Welti | 235/61.5 |
| 3,399,849 | 9/1968 | Hendrick | 244/195 |
| 3,446,946 | 5/1969 | Andeen | 244/195 |
| 3,588,007 | 6/1971 | Naumann | 244/195 |
| 3,656,043 | 4/1972 | Kawada et al. | 235/150.2 |
| 3,665,168 | 5/1972 | Canfield | 235/150.1 |

OTHER PUBLICATIONS

"Effect of Predictor Display on Carrier Landing Performance"—Part I—Experimental Evaluation and Part II—Lab. Mechanization—Prepared for Dept. of Navy—Jun. 1973.

*Primary Examiner*—Malcolm A. Morrison
*Assistant Examiner*—Errol A. Krass
*Attorney, Agent, or Firm*—Lionel L. Lucchesi

[57] ABSTRACT

A method and device are provided for displaying the effect of control action in real time by simultaneously applying the control action both to the system to be controlled and a computer model of the system. The effect of the control action on the model is displayed to the operator in a manner which dynamically decouples the display to the operator in a manner which dynamically decouples the display from the actual system's response over some suitable frequency range, thereby enhancing the stability and performance of the control system's operation. The method and device are described in conjunction with a preferred embodiment of an aircraft gun fire control system and variation of that system. A computer model or pseudo aircraft, termed a command aircraft, is programmed into a computer carried by an actual aircraft. In addition to providing conventional control information to the actual aircraft, the control actions of the pilot "fly" the command aircraft. Steering information provided to the pilot by means of display devices is referenced to the command aircraft rather than to the actual aircraft. This isolates the pilot from destabilizing time delays present in the actual aircraft, as well as from environmental disturbances such as wind gusts. The actual aircraft and the command aircraft are brought into coincidence, for example, either by slowly reorienting the command aircraft without degrading the advantages of command-aircraft-referenced displays during dynamic steering situations or by aerodynamic control action through the flight control system.

23 Claims, 14 Drawing Figures

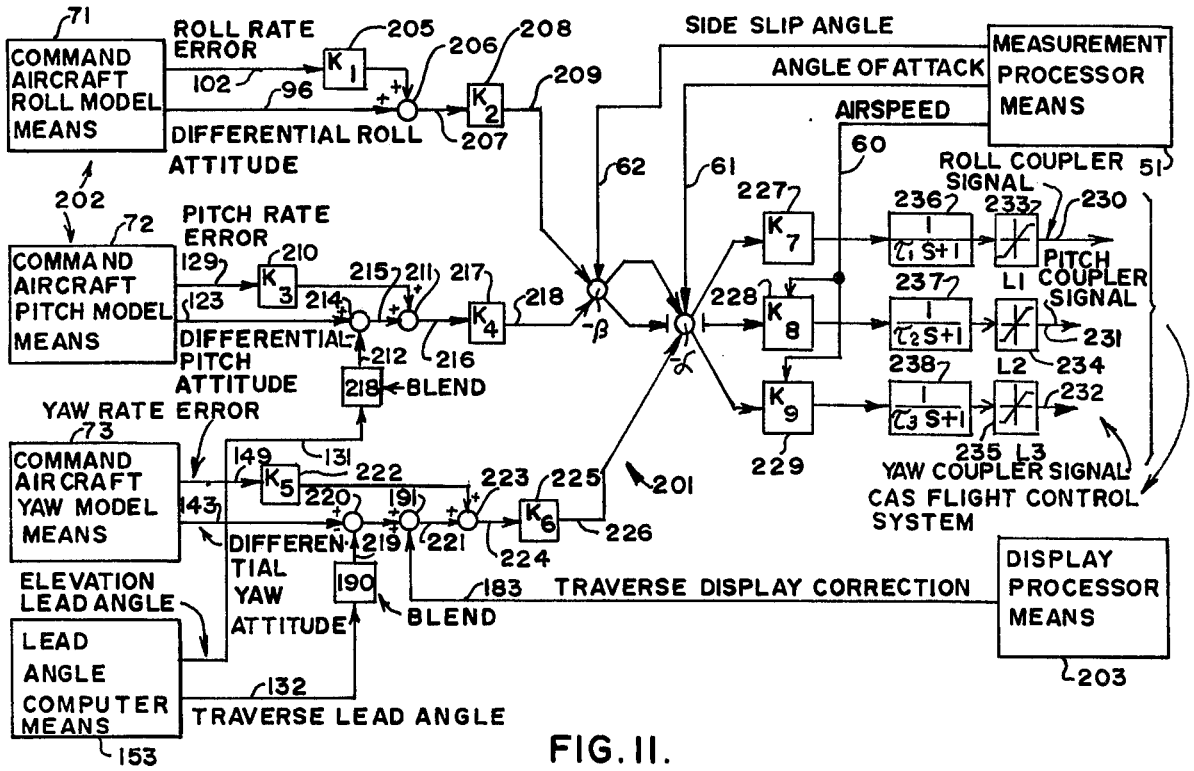
FIG. 11.
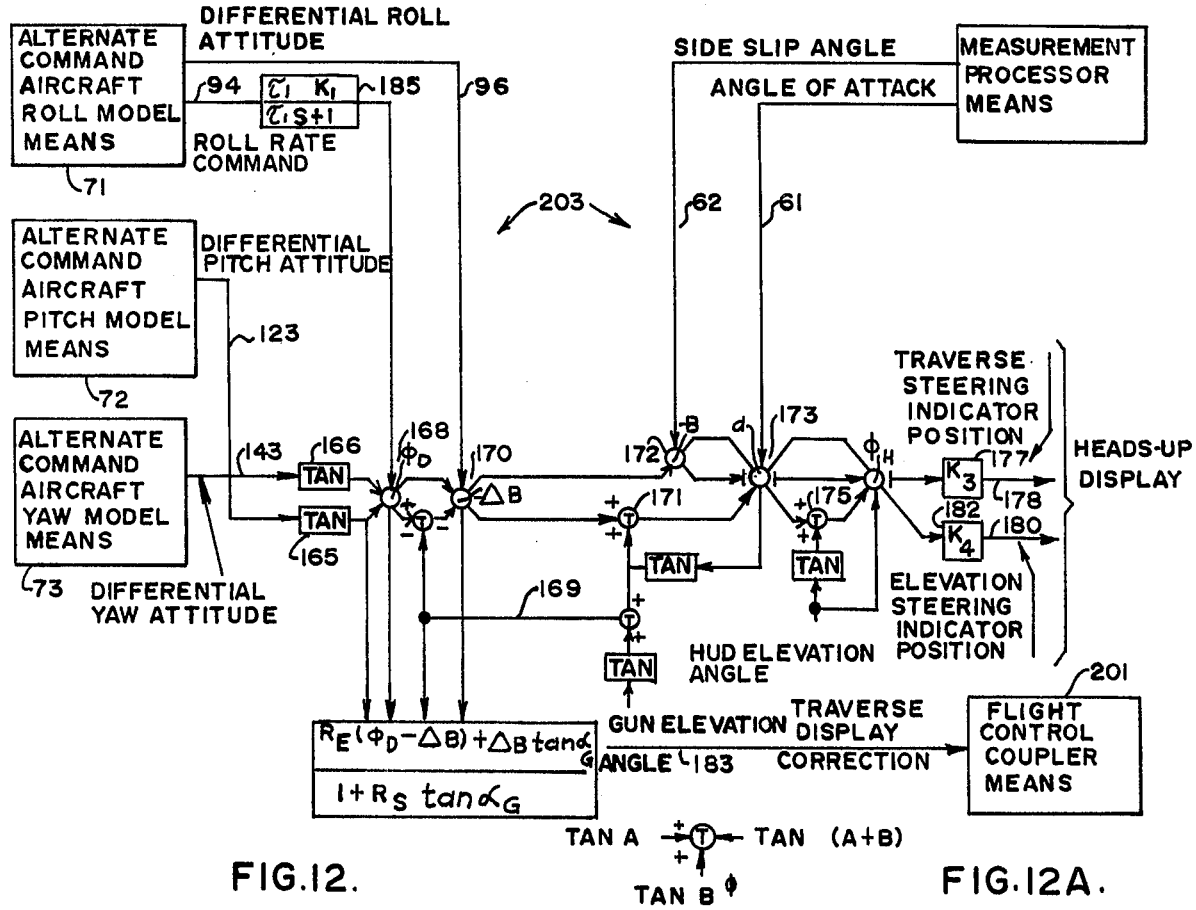
FIG. 12.
FIG. 12A.

CONTROL MEANS AND METHOD FOR CONTROLLING AN OBJECT

BACKGROUND OF THE INVENTION

This invention relates to manual feedback control systems and, in particular, to systems in which the feedback to an operator is obtained either partially or entirely from a model of the desired system response. While the invention is described with particular emphasis in association with aircraft steering control using visual feedback to the operator, those skilled in the manual control art will recognize the wide applicability of our invention to other manual control feedback systems.

The task of precisely steering modern aircraft, particularly high performance aircraft, has become increasingly difficult. The inherent delay between the time that a pilot performs a control action and the time that he can perceive its effect is such that only highly skilled and expertly trained pilots can avoid the tendency to over control the aircraft, thereby causing pilot-induced oscillations. Moreover, some steering displays are computed from measured aircraft variables such as rotational rates or accelerations. During oscillatory control periods, the oscillations can be reflected into the steering display which further aggravates the problem through regenerative feedback action. The invention disclosed hereinafter was the result of an investigation to determine the efficacy of idealized visual feedback on the problem of pilot steering control. In particular, the invention was initially conceived in an effort to improve and simplify the steering associated with air-to-air gun fire control.

The prior art approach to aircraft gun fire control (gunsight) systems and their associated displays has been based upon the use of actual measured data for steering computations. This has often resulted in display systems which exhibit the regenerative feedback action mentioned previously when aircraft rotational rates or accelerations are used. Gunsights whose displays exhibit this phenomenon are commonly referred to as "disturbed" systems. One means for alleviating the steering difficulties caused by "disturbed" gunsight systems is to utilize autonomous, stabilized target tracking devices, such as radar, electro-optical, or infrared tracking systems. Such gunsight systems (commonly referred to as "director" systems) provide measurement and corresponding displayed data which are relatively immune to the disturbing effect of aircraft motion and show a correspondingly higher performance capability during precision steering. However, director systems are costly, increase aircraft weight and space requirements, and generally fail to make maximum use of the visual tracking capability of the pilot. The invention disclosed hereinafter is intended to provide improved aircraft steering, comparable to that obtainable through the use of director gunsight systems, without the need for sophisticated autonomous tracking devices. By thus improving and making use of the tracking capability of the pilot, the invention permits the implementation of a director-type gunsight, that is, one having improved steering dynamics characteristics, without the attendant disadvantages of present director systems. The invention is further intended for use in conjunction with presently available aircraft avionics systems. In particular, the invention makes use of modern display devices which provide electronically generated images on a combining glass such that the steering display or indicator is superimposed on the pilot's forward field of view. Such displays are commonly referred to as heads-up displays and the electronic display device is called a HUD (Heads-Up-Display).

An essential feature of our invention is that displayed information is referenced not to the actual aircraft but to a model of the desired behavior of the aircraft. This provides timely and effective feedback to the pilot and promotes smooth steering. Pilot control actions are converted to signals that feed both the actual aircraft and the model or command aircraft. The actual and command aircrafts exhibit brief behavioral differences, but are driven toward coincidence, for example, either by slowly driving the command aircraft orientation to that of the actual aircraft through display means, or by driving the actual aircraft into coincidence with the command aircraft through the flight control system.

Our invention has a wide range of applications. For example, it may be used in conjunction with airborne trainable gun application in which the gun, over its degrees of freedom, is slaved to the command aircraft rather than being fixed to the actual aircraft. Also, it may be used for precise velocity vector control in tasks such as air-to-ground bombing, terrain following, or landing. In its broader aspects, it may find application in a variety of manual control systems where the inherent reaction time, control sensitivity, and inaccessibility of pertinent measurement data cause the operator difficulty in accomplishing his control task.

One of the objects of this invention is to provide an improved aircraft steering system.

Another object of this invention is to provide a low-cost aircraft steering system.

Another object of this invention is to provide a novel method of manually controlling a system by observing the effect of the control action on a model of the system using sensory feedback.

Yet another object of this invention is to provide a fire control system for aircraft which displays information to the pilot of the aircraft in terms of a model of the aircraft.

Yet another object of this invention is to provide a method for simplifying the steering task of a pilot.

Still another object of this invention is to provide an improved method to permit terrain followed by an aircraft.

Yet another object of this invention is to provide an improved system for use in automatic ground control approach systems for aircraft.

Still another object of this invention is to provide an aircraft steering system suitable for use in trainable gun applications.

Yet another object of this invention is to provide a steering control apparatus for use in conjunction with aircraft flight control systems having a multi-mode operational characteristic.

Another object of this invention is to provide a low-data-rate means for providing remote steering of nonpiloted aircraft.

Other objects of this invention will be apparent to those skilled in the art in light of the following description and accompanying drawings.

SUMMARY OF THE INVENTION

In accordance with this invention, generally stated, an apparatus and method are provided which enable an operator to perform a control function on a system by observing an idealized system model operation and then conforming the actual system operation to the idealized model. In the preferred embodiment, the system is an aircraft and its associated flight control mechanisms. A mathematical model, called the command aircraft model, of the desired aircraft response is programmed in a computer carried by the aircraft. Conventional display means are utilized to apprise the pilot of events connected with the steering control function of the aircraft. However, the results of control actions taken by the pilot are displayed with respect to the command aircraft model, which reacts with idealized behavior relative to the control action. The control actions taken by the pilot also are an input to the conventional flight control system of the aircraft. Means are provided to bring the actual aircraft into compliance with the command aircraft model when the real time difference between them is not zero.

BRIEF DESCRIPTION OF THE DRAWINGS

In the drawings,

FIG. 11 is a detailed block diagrammatic view of a command aircraft flight control coupler means used in conjunction with the command aircraft steering system of FIG. 10;

FIG. 12 is a detailed block diagrammatic view of a command aircraft display processor means shown in FIG. 10; and FIG. 12*a* is a diagrammatic view of a difference of tangents device used in conjunction with the display processor means of FIG. 12.

DESCRIPTION OF THE PREFERRED EMBODIMENT

Figure 1:
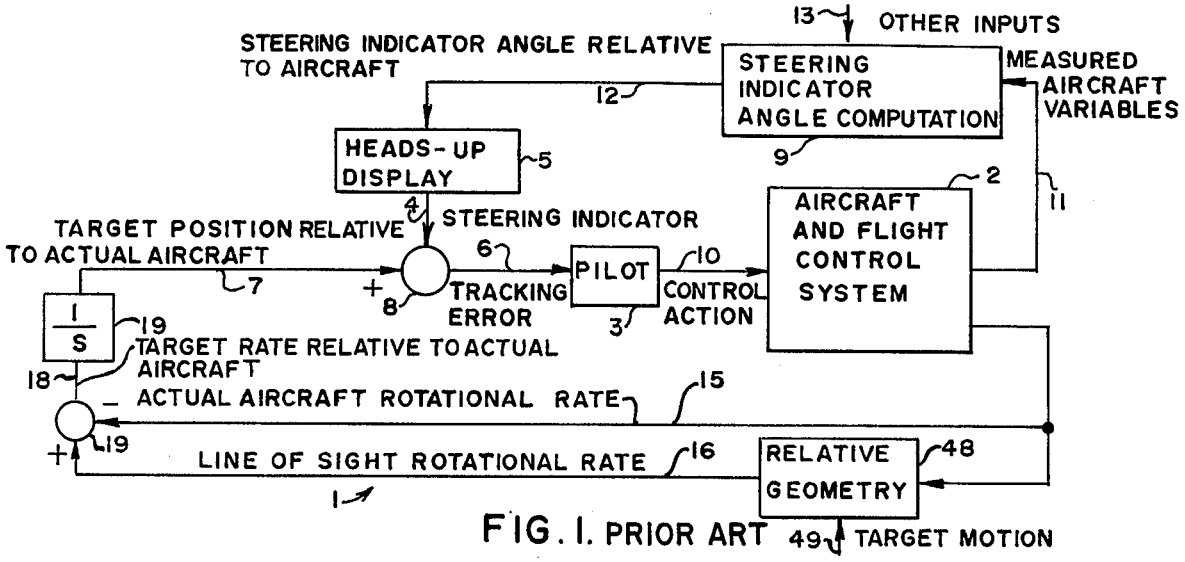
FIG. 1. PRIOR ART
FIG. 1 is a simplified, singleaxis block diagrammatic view of a conventional aircraft steering system configuration.

Referring to the drawings more particularly by reference numbers, numeral 1 in FIG. 1 refers to a simplified, single-axis representation of a representative conventional prior art aircraft steering configuration. The particular axis chosen for comparative discussion represents the pitch axis of aircraft movement. Pitch, yaw and roll axes correspond to the conventional Y, Z and X axes, respectively, of a Cartesian coordinate system. Block diagram symbology is used throughout this specification to define the functional requirements and describe the operation of the disclosed systems. The symbolic notation utilized in the drawings includes: (1) selected Laplace transform transfer functions with various properly selected time constants $\tau$ and gains K; (2) blocks showing graphically the input-output relationship thereof with the abscissa as the input axis and the ordinate as the output axis; and (3) Pio-diagram representations of coordinate transformations. Further background information regarding Pio-diagram functions and their use may be obtained in IEEE, vol. ANE-11, pp. 128–134 (1964).

In the conventional aircraft steering configuration 1 of FIG. 1, an aircraft and its associated flight control system, indicated generally by the numeral 2, receives control command inputs from a pilot 3. The aircraft, for the purposes of this specification, may comprise any of a variety of commercially available devices and the flight control system may include force and displacement pick-offs as elements of the pilot's control device or stick, not shown, which are utilized to position an aircraft's roll, pitch, and yaw axes.

Steering is accomplished by a pilot's control action indicated generally by the numeral 10, required to superimpose over the visually observed target a steering indicator symbol 4 which is displayed to the pilot 3 on a windshield combining glass by means of a heads-up display device 5. Angle tracking error 6 is based on the pilot's visual observation difference in angular direction to the target with respect to the steering indicator 4 of the display 5. This pilot made determination of tracking error 6 is representatively shown by a differencing operator 8. That is to say, the pilot observes both a target position relative to the actual aircraft, shown as numeral 7, and the steering indicator 4 as they appear relative to the aircraft 2, and he notes their angle difference, or tracking error 6. The manner in which the target is observed relative to the aircraft 2, indicated by the numeral 7, is a complex geometric problem which is simplified for exaplanation purposes by first illustrating actual aircraft rotational rate by the numeral 15. Also shown is a line of sight rotation rate 16 which results from the relative geometry effects, indicated generally by the numeral 48, of the actual aircraft rotational rate 15 and the target motion, represented by a numeral 49. The kinematic difference between the line of sight rotational rate 16 and the actual aircraft rotational rate 15 is indicated by a differencing operator 17. A resulting difference rate 18 then, represents the target rate relative to the actual aircraft. Kinematic integration of the difference rate 18, represented by an integrator 19, yields the target position relative to actual aircraft 7.

The steering indicator presented to the pilot 3 is obtained from a steering indicator angle computation means 9 operatively connected to the display 5. The particular steering indicator angle computation means 9 utilized varies depending upon the nature of the specific steering task being addressed. Many aircraft control functions can be accomplished by utilizing three essentially different steering references, as follows:

(1) Fuselage-referenced steering, which relates to pointing a steering indicator that is fixed in some specified direction or varied in some specified manner with respect to the longitudinal axis of the fuselage of the aircraft 2;

(2) Velocity-referenced steering, which relates to pointing a steering indicator that is fixed in some specified direction or varied in some specified manner with respect to the velocity vector of the aircraft 2; or (3) Gun-referenced steering, which relates to pointing a steering indicator that is fixed in some specified direction or varies in some specified manner with respect to the gunline of the aircraft 2. The angle between the gunline of the aircraft 2 (defined by a gunline indicator) and the steering line (defined by the steering indicator presented at the display 5) is known in the art and defined for the purposes of this specification as lead angle.

Depending on the particular steering task under consideration, the output of the computation means 9, shown in FIG. 1 as a steering indicator angle 12, may be a constant, a function of measured aircraft variables indicated by the numeral 11; or a function of other inputs shown as a numeral 13, such as altitude or relative air density.

In the conventional steering system 1 depicted in FIG. 1, significant delay time and/or underdamped response exists between the pilot's control action taken to null the tracking error 6 between the steering indicator 4 and the observed angular position of the target 7. These non-ideal response characteristics lead many pilots to over control the aircraft 2, thereby causing pilot-induced oscillations in the orientation of the aircraft. Moreover, for steering systems in which the steering indicator angle 12 is computed from measured aircraft variables 11, these oscillations form a distributing input to the display means 5, which further contributes to the difficulty of the pilot's tracking task.

Figure 2:
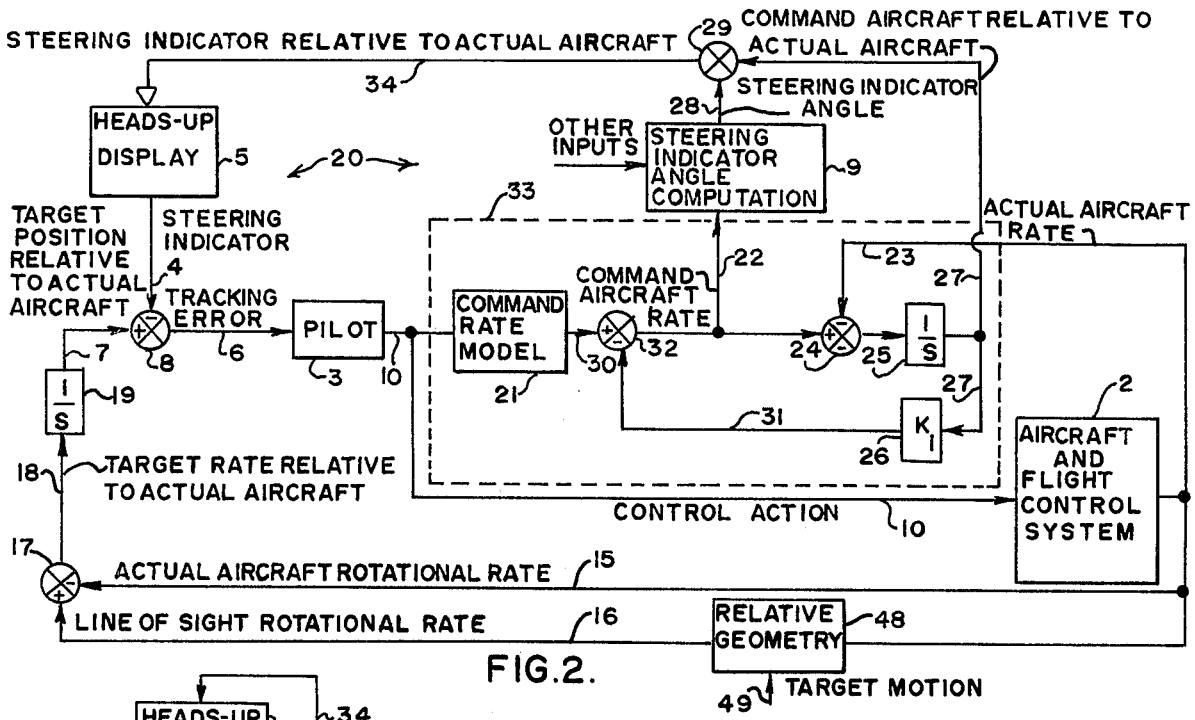
FIG. 2 is a simplified, single-axis block diagrammatic view of one illustrative command aircraft steering system configuration.

FIG. 2 shows a simplified, single-axis representation of one illustrative embodiment of command aircraft steering system 20 of our invention, for comparison with the representative conventional steering system of FIG. 1, like reference numerals being utilized where appropriate. The objective of the command aircraft steering system 20 is to provide a novel display method which alleviates the oscillatory behavior heretofore prevalent in aircraft steering. The command aircraft steering system 20 utilizes the effect of the pilot 3 control action by simultaneously applying the control action both to the actual aircraft and its associated flight control system 2 and to an idealized aircraft computer model or command aircraft 33, which possesses the desired aircraft response. A command rate model 21 receives pilot control action as an input 10 and converts the pilot control action input 10 into a rate command output 30. A command aircraft rate 22 is obtained by differencing the rate command 30 with a feedback signal 31 at a differencing means 32. The feedback signal 31 is obtained from an output 27 of a differencing means 24 and an integrator 25. Differencing means 24 receives a second input 23 representing actual aircraft rate conditions. The output 27 of the differencing means 24 and integrator 25 is the differential attitude between the command aircraft 33 and the actual aircraft 2. The feedback signal 31 is proportional to the differential attitude 27 between the command aircraft 33 and the actual aircraft 2, the constant of proportionality being established by a gain means 26. The pilot's desired rate command 30 is slowly reduced through the feedback signal 31, thereby slowly reducing the differential attitude 27 through the action of integrator 25, thus reorienting the command aircraft toward coincidence with the actual aircraft.

As indicated, the output 27 of integrator 25 is a measure of the differential attitude between the command aircraft 33 and the actual aircraft 2. Since a long-term attitude discrepancy between the command aircraft 33 and the actual aircraft 2 would result in steady-state pointing errors, the command aircraft is gradually realigned to the actual aircraft through the action of gain means 26. A steering indicator angle 28 computed in the steering indicator angle computation means 9 is combined with the differential attitude 27, using a summation means 29, to obtain a steering indicator position 34 relative to aircraft coordinates for display to the pilot using the heads-up display device 5. Proper selection of gain means 26 provides a dynamically suitable departure of the command aircraft attitude from the actual aircraft attitude for display purposes during periods of changing pilot control action without introducing intolerable pointing error during periods of smooth control action.

It thus may be observed that the steering indicator angle 28 is referenced to the command aircraft's orientation rather than to the actual aircraft's orientation, thereby dynamically isolating, to the degree provided by gain means 26, the steering indicator 4 from the actual aircraft. The effect of pilot control action 10 converted into command aircraft rate 22 is immediately displayed to the pilot as a motion of the steering indicator 4 through the action of integrator 25. This provides the pilot with timely information relating the effect of his control actions to the tracking task, thereby mitigating any tendency to over control the aircraft and induce steering oscillations.

A second beneficial result is obtained with regard to certain types of steering indicator angle computations which utilize measured aircraft variables. As shown in FIG. 2, the command aircraft steering system 20 enables these variables to be obtained from the command aircraft model 33. An example of the variables obtainable is the command aircraft rate 22 utilized in the steering indicator angle computation means 9. This is contrasted with the necessity of using measured aircraft variables 11 in conventional steering systems 1 represented in FIG. 1. The use of command aircraft 33 variables further reduces steering oscillations by providing less oscillatory steering indicator angles. Moreover, the use of command aircraft variables obviates the need for some special-purpose measurement devices for steering indicator angle computation.

Figure 3:
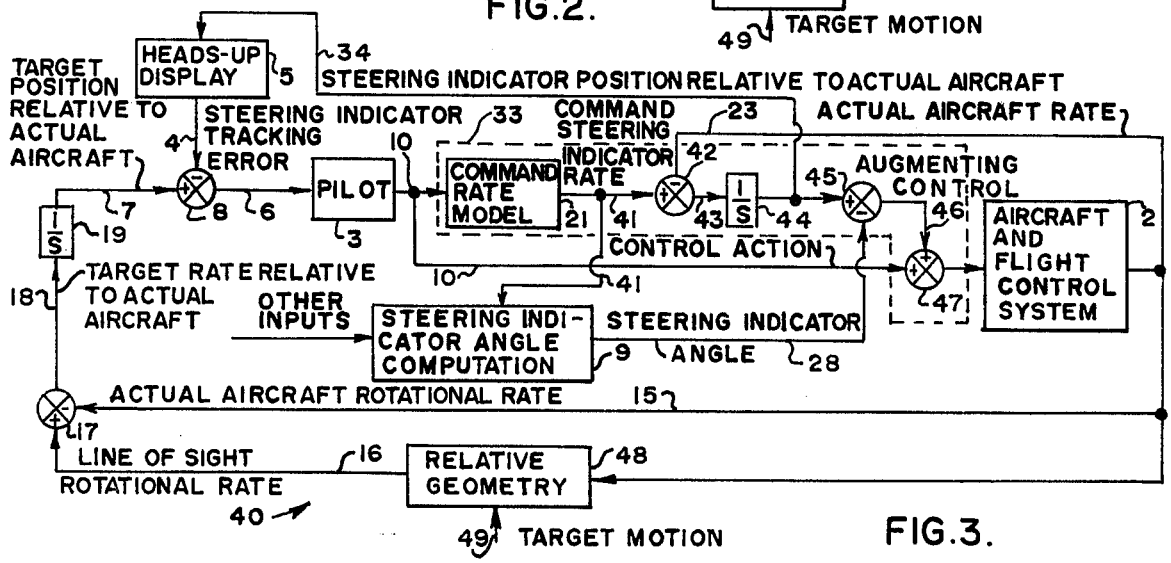
FIG. 3 is a simplified, single-axis block diagrammatic view of a second illustrative command aircraft steering system configuration.

The command aircraft steering system 20 configuration shown in FIG. 2 provides the function of driving the command aircraft and the actual aircraft into coincidence by slowly rotating the command aircraft back to the actual aircraft by means of the feedback gain means 26. An alternate command aircraft steering system 40 mechanization, illustrated in FIG. 3, provides the function of driving the command aircraft 33 and the actual aircraft 2 into coincidence by rotating the actual aircraft 2 to the command aircraft 33 by coupling the command aircraft 33 to the actual aircraft and its associated flight control system 2. Another feature of the embodiment shown in FIG. 3 is the indirect introduction of the steering indicator angle 28 into the display means 5 by feeding it through the flight control coupler to the flight control system, rather than the direct introduction used in conjunction with the embodiment of FIG. 2. This feature provides automatic adjustment of the aircraft's orientation as a function of changing steering indicator angle without the need for pilot control action, thereby further minimizing pilot-induced oscillations due to variation in the steering indicator angle.

Referring to FIG. 3, the pilot's control action 10 simultaneously acts upon both the aircraft and its associated flight control system 2 and the command rate model 21. The command rate model 21 establishes, in this illustrative embodiment, a command steering indicator rate 41. Command steering indicator rate 41 is differenced with the actual aircraft rate 23 at a differencing means 42, and the resulting error rate 43 is accumulated by an integrator 44. The output 34 of the integrator 44 represents the steering indicator angle relative to the actual aircraft 2 due to the manner in which the steering indicator angle 28 is introduced into the flight control system.

As shown, the integrator 44 output is differenced with the steering indicator angle 28 at a differencing means 45. The output of the differencing means 45, indicated as an augmenting control signal 46, is combined with the pilot's control action 10 at a coupling means 47, and applied to the aircraft through its associated flight control system 2. Those skilled in the art will recognize that the use of a single coupling means 47 is for illustrative purposes and that the augmenting control signal 46 may be applied at various points in the actual aircraft and flight control system 2. The feedback action of the actual aircraft rate 23 in combination with integrator 44 serves to null the augmenting control signal 46. When this nulling action is perfectly achieved, the output of the integrator 44 equals the steering indicator angle 28. When the nulling action is imperfect, the output of the integrator 44 equals the steering indicator angle 28 plus the differential attitude between the command aircraft and the actual aircraft. Thus, the action of the augmenting control signal 46 serves the dual purposes of driving the actual aircraft into coincidence with the command aircraft and providing a steering angle indication to the pilot in accordance with the steering indicator angle 28.

As thus described, a system is disclosed in which the effect of a control action affecting the system is displayed to the operator of the system in a manner which dynamically decouples the display from the actual system's response over some suitable frequency range, thereby enhancing the ability of the operator to control the operation of the system.

Figure 4:
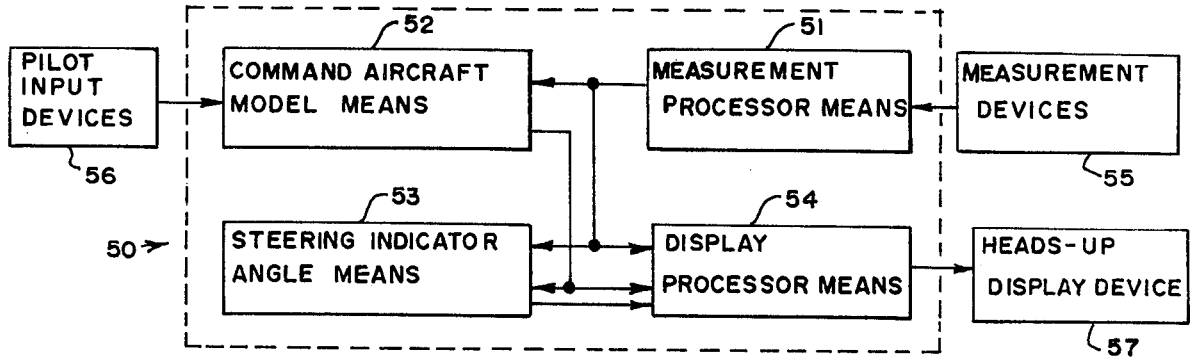
FIG. 4 is a block diagrammatic view of the essential operative portions of a multi-axis command aircraft steering system configuration.

FIGS. 4 through 9 illustrate in greater detail a three-axis embodiment of command aircraft steering system of our invention corresponding to the simplified, single-axis description presented in FIG. 2. As shown in FIG. 4, reference numeral 50 indicates a command aircraft steering system designed for use with conventional aircraft and flight control systems. However, the system 50 can be adapted easily to other aircraft flight control combinations, including, for example, advanced control-configured vehicles which have a digital, fly-by-wire flight control system and which employ both direct lift and direct side-force controllers. Included in FIG. 4 are the essential operative portions of the system 50 and their interconnection means with each other and with other aircraft subsystems.

The command aircraft steering system 50 includes a measurement processor means 51 which is adapted to receive measured data from various aircraft measurement devices 55. In the embodiment illustrated, measurements from a three-axis body-rate gyro package, an air data computer, and an inertial navigation system, not shown, are processed in a specific manner, as later described. However, a variety of other aircraft motion measurement devices may be used alternately, including both attitude heading reference sets and appropriately mounted two-degree-of-freedom gyro and accelerometer devices. Thus, the three-axis, body-rate gyro package can be eliminated in other embodiments of our invention and equivalent results achieved by appropriate processing of inertial navigation system measurements. Body rate gyro packages, air data computers, and inertial navigation systems are well known, commercial devices utilized for obtaining specific information. Consequently, they are not described in detail.

The measurement processor means 51 converts the measured data to a tractable form for use elsewhere in the command aircraft steering system 50. The means 51 transforms the measurement data representing actual aircraft motion variables into a command aircraft model coordinate system for comparison with the corresponding desired motion variables of the command aircraft model. The measurement processor means also computes the effect of gravitational force on the components of actual aircraft motion for use in this comparison. The comparison of the processed motion variables with desired motion variables is accomplished by a command aircraft model means 52.

The command aircraft model means 52 combines pilot input signals from various pilot input devices 56 with the components of actual aircraft motion due to the effect of gravitational force to develop the desired motion variables of the command aircraft model 52. In the present embodiment, the pilot's control stick and rudder pedals are employed as pilot input devices. However, a variety of alternate pilot input devices may be utilized, including, for example, sidearm controllers, head motion sensors, occulometers, and other advanced pilot input devices. These desired motion variables are then compared to the processed motion variables of the actual aircraft, obtained from the measurement processor means 51, to determine a measure of the difference in spatial orientation, or differential attitude, between the command aircraft model and the actual aircraft. This differential attitude is used in a display processor means 54 to provide a steering indicator for display to the pilot on a heads-up display device 57 thereby referencing the pilot steering task to the command aircraft model rather than to the actual aircraft.

The complete steering indicator display is achieved as follows. A steering indicator angle computation means 53 determines a steering indicator angle defining the angular position of the pilot's basic steering indicator relative to the orientation of the command aircraft model. This steering indictor angle is introduced into the display processor means 54 by combining it with the differential attitude received from the command aircraft model means 52. The combined signal is appropriately transformed to determine the angular position of the steering indicator relative to the actual aircraft orientation. Included in the angle transformations accomplished in the display processor means 54 is a lagged-pitch-plane angle which provides damping to the lateral, or traverse, channel for certain steering tasks. The angle position data obtained from the display processor means 54 are used in the heads-up display device 57 to display the steering indicator to the pilot. In the embodiment illustrated, a cathode-ray-tube heads-up display device, previously described, is utilized for display purposes. However, a wide variety of other display devices are available including traditional electromechanical and advanced helmet-mounted display devices.

Figure 5:
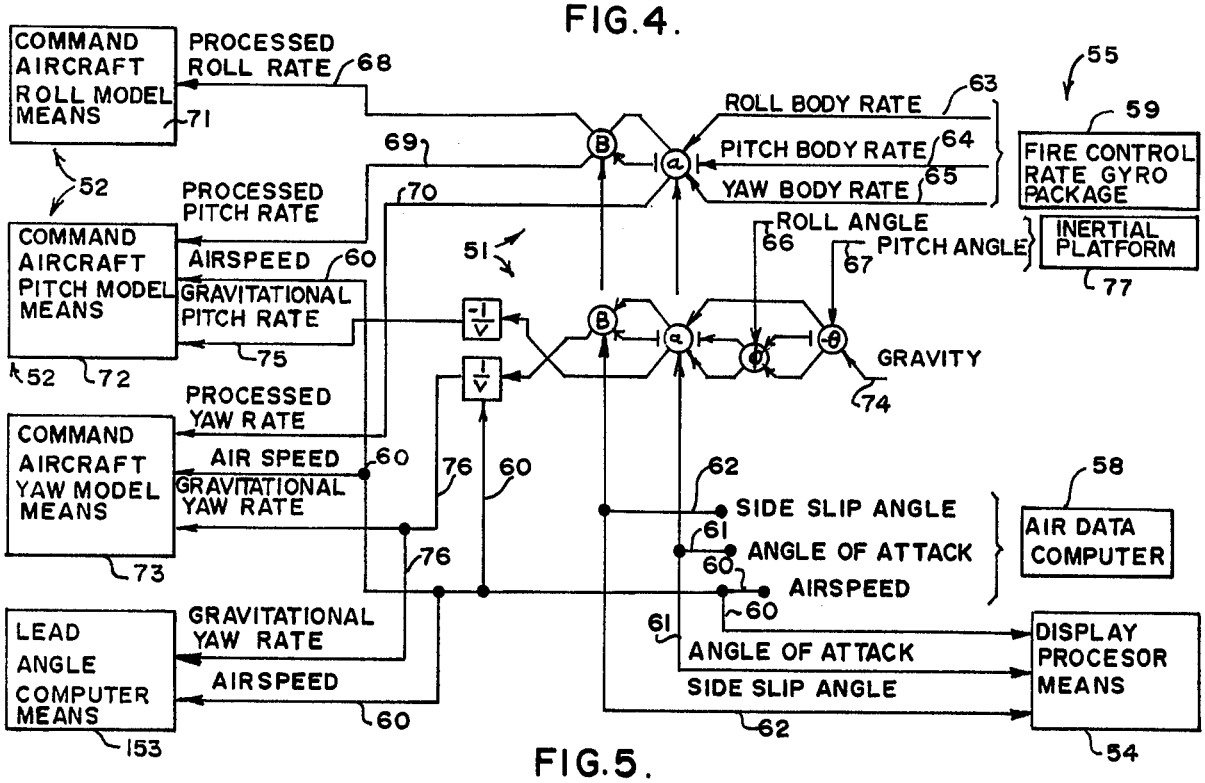
FIG. 5 is a detailed block diagrammatic view of the measurement processor shown in FIG. 4.

The measurement processor means 51 performs three functions: interface and signal conditioning of the measured variables obtained from the measurement devices 55; transformation of measured aircraft body rates from actual aircraft body coordinates into command aircraft coordinates; and computation of the effect of gravitational force on the aircraft's turning rate. FIG. 5 shows means and a method for performing these functions. Measured variables used in the command aircraft steering system 50 are: airspeed 60, angle of attack 61, and sideslip angle 62 obtained from an air data computer 58; roll body rate 63; pitch body rate 64, and yaw body rate 65 obtained from a body-rate gyro package 59; and roll attitude angle 66 and pitch attitude angle 67 obtained from an inertial platform or attitude-heading reference set 77.

The measured roll rate 63, pitch rate 64, and yaw rate 65 are rotated from body coordinates into velocity vector (wind) coordinates using angle of attack 61 and sideslip angle 62. The processed roll rate 68, pitch rate 69, and yaw rate 70 are used in a command aircraft roll model means 71, pitch model means 72, and yaw model means 73, respectively, as discussed in detail in following sections. Since the processed body rates are rotated to velocity vector coordinates, the command aircraft coordinate system is referenced to the velocity vector coordinates rather than to the aircraft body coordinates.

The effect of gravitational force on aircraft turning rate is computed by projecting gravitational acceleration 74, a constant stored in the aircraft computer, into the velocity vector coordinate system and computing the resulting turning rates in pitch 75 and yaw 76 using measured airspeed 60. Gravitational pitch rate 75 is an input to the command aircraft pitch model means 72, while gravitational yaw rate 76 is an input to the command aircraft yaw model means 72 and to a lead angle computer means 153.

The command aircraft model means 52 used in conjunction with the command aircraft steering system 50, includes the command aircraft roll model means 71, the command aircraft pitch model means 72, and the command aircraft yaw model means 73.

Figure 6:
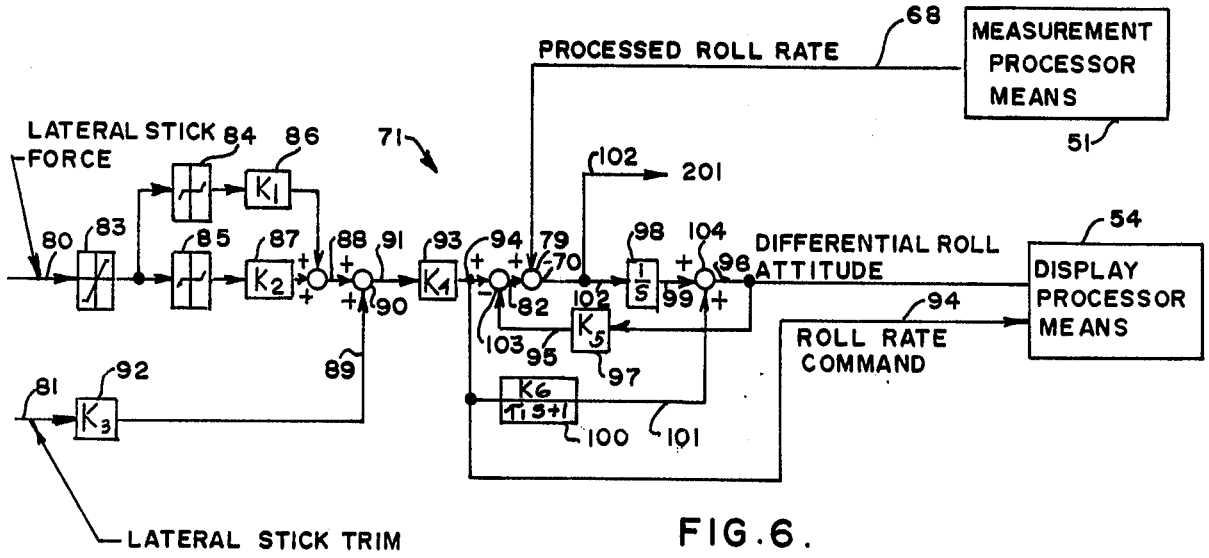
FIG. 6 is a detailed block diagrammatic view of a command aircraft roll model means used in conjunction with the command aircraft steering system of FIG. 4.

As indicated, the command aircraft model means 52 receives signal inputs from the pilot input devices 56. FIG. 6 shows the conversion of a lateral stick force 80 and a lateral stick trim position 81 from the input devices 56 into a command aircraft roll rate signal 82, in a manner compatible with the lateral control stick and flight control system characteristics of the aircraft. The embodiments of our invention disclosed herein are designed to interface with a dual-gradient roll rate command flight control system. In that interface function, the control stick lateral stick force signal 80 is limited by a limiting device 83, the device 83 providing a maximum allowable force output. If the magnitude of the measured force at the output of device 83 does not exceed either of a deadzone 84, or a deadzone 85, the roll rate command from the pilot's lateral stick input is zero. If deadzone 84 is exceeded, but deadzone 85 is not exceeded, a gain means 86 establishes the gradient of the curve relating command aircraft roll rate versus the pilot's lateral stick force 80. If both deadzone 84 and 85 are exceeded, the gradient of the curve relating command aircraft roll rate versus pilot's lateral stick force 80 equals the sum of gain means 86 and a gain means 87. The command roll rate due to lateral stick force, indicated by the numeral 88, is added to a command roll rate due to stick trim 89, at a summing device 90. A gain means 92 provides the proper scaling between the lateral stick strim position 81 and the resulting command roll rate due to stick trim 89. The output of the summing device 90 represents pilot commanded roll rate 91. Pilot commanded roll rate 91 is an input to a gain means 93, which is a scale factor that provides common dimensional units between command aircraft roll rate 82 and processed roll rate 68. Processed roll rate is obtained from the measurement processor means 51 previously discussed. An output 94 of gain means 93 is scaled by gain means 93 and combined in a differencing means 103 with a feedback signal 95 to provide the command aircraft roll rate 82.

It should be noted that the command aircraft roll rate 82 is obtained by differencing the scaled pilot commanded roll rate 94 with the feedback signal 95. Feedback signal 95 is proportional to a differential roll attitude 96 between the command aircraft and the actual aircraft, the constant of proportionality being established by a gain means 97. Thus, the pilot commanded roll rate 94 is reduced by an amount proportional to the differential roll attitude 96; thereby reducing the differential roll attitude through the action of an integrator 98, that is, reorienting the command aircraft roll attitude toward coincidence with that of the actual aircraft.

The difference between the command aircraft roll rate 82 and the processed roll gate 68, indicated by the numeral 102, is accumulated through the action of the integrator 98. An output 99 of the integrator 98 is a component of the differential roll attitude between the command aircraft and the actual aircraft. The pilot commanded roll rate signal 94 is passed through a low-pass filter 100 and the resultant output 101 is added to the integrator output 99 at a combining means 104 to produce the complete differential roll attitude 96 for the subsequent use in the display processor means 54. The filtered pilot commanded roll rate signal 101 provides feedforward or quickening action of the pilot's roll rate command to the display processor means. This enhances tracking stability by providing a quick display indication to the pilot. This quickening term was not included in the simplified single-axis description given in conjunction with FIG. 2.

The initial value of the integrator output 99 is set equal to the negative of the output 101 of the low-pass filter 100. This establishes a zero initial value of the differential roll attitude 96. That is, the command aircraft initially is oriented in roll to coincide with the actual aircraft.

Figure 7:
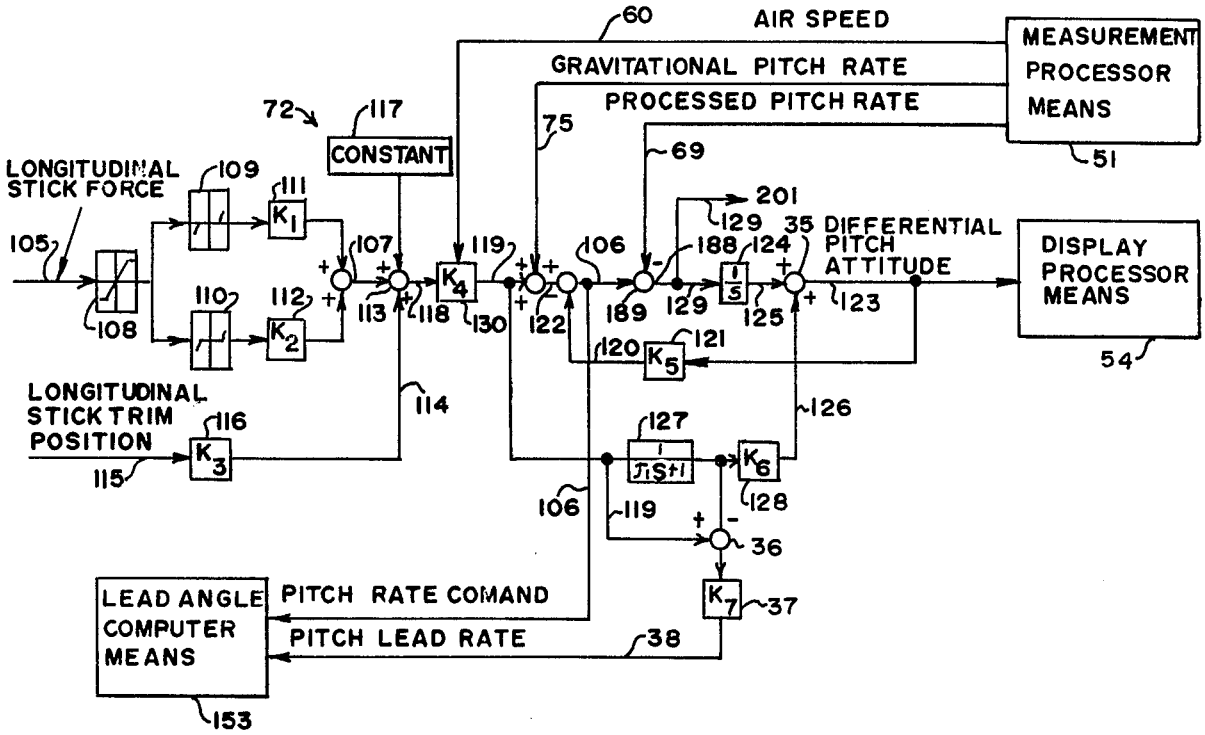
FIG. 7 is a detailed block diagrammatic view of a command aircraft pitch model means used in conjunction with the command aircraft steering system of FIG. 4.

The command aircraft pitch model means 72 shown in FIG. 7 has a structure much like that of the command aircraft roll model means 71. The pilot's longitudinal control stick force 105 is measured and converted into a command aircraft pitch rate signal 106. Dual-gradient control stick characteristics are modeled to match those of the aircraft's flight control system. In the case of longitudinal stick force, incremental normal acceleration is commanded. Incremental normal acceleration is defined in the art and for purposes of this specification as the total acceleration (as measured by an accelerometer) normal to the aircraft's wings expressed in acceleration of gravity units (g), less one acceleration of gravity unit, i.e., measured *g*'s less one *g*. Thus, the first operation in the command aircraft pitch model 72 is to convert the measured stick force 105 into one of the components of commanded incremental normal acceleration 107. A limiter 108, two deadzones 109 and 110, and two gain means 111 and 112, respectively, are used to model the dual gradient stick characteristics in the same manner as that described in conjunction with the command aircraft roll model means 71 of FIG. 6. A summing device 113 is used to add on the effect in *g*'s of a longitudinal stick trim signal 114, the other component of commanded incremental normal acceleration. This component is obtained by multiplying a stick's trim position input 115 by a scale factor provided by a gain means 116. The summing device also adds a one *g* constant, indicated by the numeral 117, the constant being stored in the computer of the aircraft, thereby computing a signal 118 representing the total normal acceleration (as measured by an accelerometer) command of the pilot.

The total normal acceleration command 118 is converted to a corresponding command aircraft pitch rate component 119 by using measured airspeed 60 from the measurement processor means 51 in conjunction with a gain means 130. The total command aircraft pitch rate 106 is obtained by first adding the effect of the gravitational force on pitch rate 75, as computed by measurement processor means 51, to obtain a command pitch rate 122, and by then subtracting a feedback signal 120. Feedback signal 120 is proportional to the differential pitch attitude 123 between the command aircraft and the actual aircraft, the constant of proportionality being established by gain means 121. Thus, the commanded pitch rate 122 is reduced by an amount proportional to the differential pitch attitude 123; thereby reducing the differential pitch attitude through the action of an integrator 124, that is, reorienting the command aircraft pitch attitude toward coincidence with that of the actual aircraft.

Pitch rate error 129, which is the difference between the command aircraft pitch rate 106 and the processed pitch rate 69 from the measurement processor means 51, is accumulated by the integrator 124. An output 125 of the integrator 124 is a component of the differential pitch attitude between the command aircraft and the actual aircraft. It is combined with a filtered command aircraft pitch rate signal 126 at a summing device 35, to produce the complete differential pitch attitude 123 for subsequent use in the display processor means 54. As in the roll model, the filtered command aircraft pitch rate signal 126 provides feedforward or quickening action of the pilot's pitch rate command 119 to the display processor means 54, thereby enhancing tracking stability.

The initial value of integrator output 125 is set equal to the negative of the initial output 126 of a low-pass filter 127 as multiplied by a gain means 128. This establishes a zero initial value of the differential pitch attitude 123, that is, the command aircraft is initially oriented in pitch to coincide with the actual aircraft.

The pitch rate component 119 also is a first input to a summing means 36. Summing means 36 receives a second input from the output side of the low pass filter 127. Output of the summing means 36 is an input to a gain means 37, the output of which is a pitch lead rate signal 38 input to the lead angle computer means 153. Computer means 153 also receives command aircraft pitch rate 106 as an input.

Figure 8:
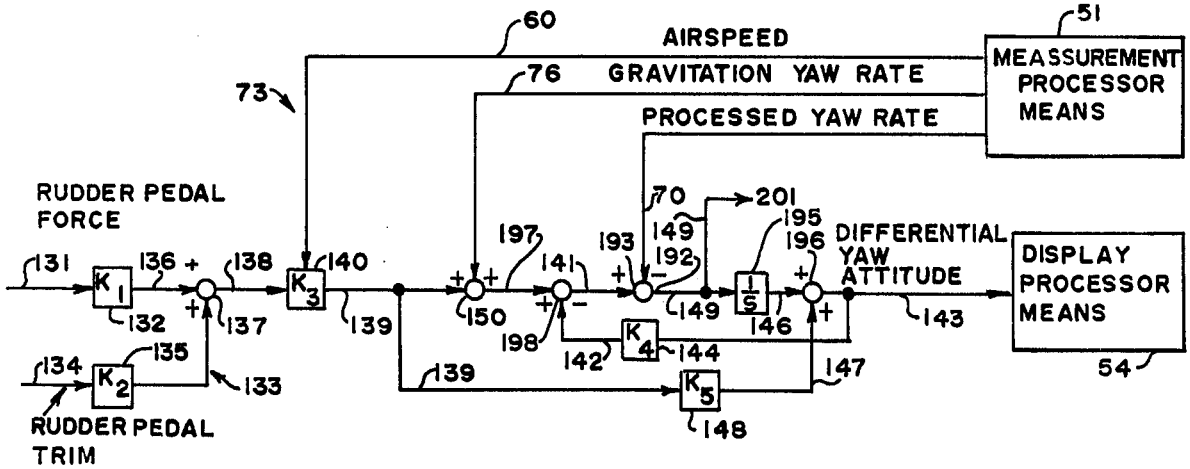
FIG. 8 is a detailed block diagrammatic view of a command aircraft yaw model means used in conjunction with the command aircraft steering system of FIG. 4.

FIG. 8 illustrates the command aircraft yaw model means 73. Rudder pedal force 131, as measured for example by means of a force transducer (not shown), is converted to one of the components of a rudder pedal total lateral acceleration (as measured by an accelerometer) command 136 by gain means 132. An additional lateral acceleration command 133 due to rudder pedal trim position 134, as computed by multiplying the trim position by the gain of a gain means 135, is added to the rudder lateral acceleration command 136 using a summing device 137 to obtain a total lateral acceleration (as measured by an accelerometer) command 138. This is converted into a corresponding command aircraft yaw rate component 139 by a gain means 140, which also receives measured air speed 60 from the measurement processor means 51 so that the command aircraft yaw rate component 139 is a function of the measured airspeed 60. The total command aircraft yaw rate 141 is obtained by first adding the effect of the gravitational force on yaw rate 76, as computed by the measurement processor means 51, to the yaw rate command 139 at a summing means 150 to obtain a commanded yaw rate 197, and then subtracting a feedback signal 142 at a summing means 198. Feedback signal 142 is proportional to the differential yaw attitude 143 between the command aircraft and the actual aircraft, the constant of proportionality being established by gain means 144. Thus, the commanded yaw rate 197 is reduced by an amount proportional to the differential yaw attitude 143, thereby reducing the differential yaw attitude through the action of an integrator 195, that is, reorienting the command aircraft yaw attitude toward coincidence with that of the actual aircraft.

Yaw rate error 149, which is the difference between command aircraft yaw rate 141 and the processed yaw rate 70 from the measurement processor means 51, is accumulated by integrator 195. An output 146 of the integrator 195 is a component of the differential yaw attitude 143 between the command aircraft and the actual aircraft. A second component of the differential yaw attitude 143 is a feedforward aircraft yaw rate 147 which is added to the integrator output 146 at a summing means 196 to obtain the total differential yaw attitude 143. The feedforward yaw rate 147 is obtained by multiplying the commanded yaw rate 139 by a predetermined gain through the action of gain means 148. Integrator 195 is initialized so that the differential yaw attitude 143 initially is zero.

The command aircraft model means 52 just described generates the differential roll, pitch and yaw attitude between the command aircraft and the actual aircraft by integrating their respective differential angular rates. This method requires that aircraft body rate measurements be provided through the use of rate gyroscopes as measurement devices 55. An alternate, but equally effective, command aircraft model means could employ aircraft body orientation (attitude) measurements available from a stabilized platform, as, for example, from an inertial navigation system. In this latter approach, command aircraft attitude would be referenced to the stabilized platform coordinates by deriving an analytic representation of the rotation from platform coordinates to command aircraft body coordinates, for example, by either a direction cosine or a quaternion representation, with command aircraft rates. The command aircraft's attitude would be initialized at the actual aircraft's measured attitude. The differential roll, pitch and yaw attitudes between the command aircraft and the actual aircraft would then be defined by the rotation required to transform the analytic representation of the command aircraft's attitude to the corresponding measured representation of the actual aircraft's attitude. This required rotation is easily obtained, for example, by post-multiplying the direction cosine matrix representing the command aircraft's attitude by the matrix inverse of the direction cosine matrix obtained from measurements of the actual aircraft's attitude.

Figures 9, 9A:
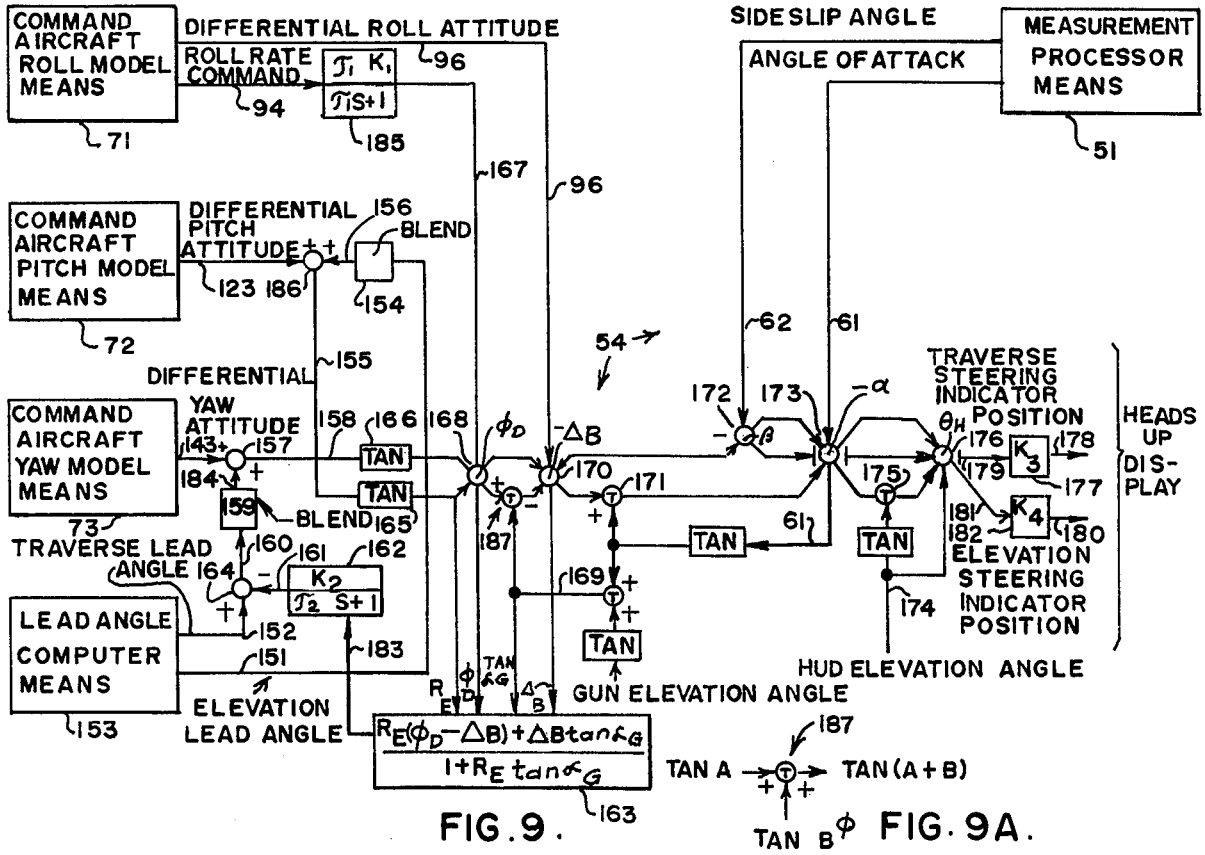
FIG. 9 is a detailed block diagrammatic view of the display processor means shown in FIG. 4.
FIG. 9*a* is a diagrammatic view of a difference of tangents device used in conjunction with the display processor means of FIG. 9.

The display processor means 54 used in conjunction with the system 50 is illustrated in FIG. 9. An elevation component 151 and a traverse component 152 of lead angle are computed in the lead angle computer 153. The lead angle computer 153 is conventional. The computer 153 may utilize any of a variety of well known methods for computing the required angular displacement of the aircraft's gunline with respect to the target to establish effective gunfire. Consequently, it is not described in detail.

The elevation component of lead angle 151 is gradually added to the differential pitch attitude 123, computed in the command aircraft pitch model means 72, at a summing device 186. This gradual blending of elevation lead angle with the differential pitch attitude is used to prevent sudden, disconcerting changes in the location of the steering indicator on the pilot's heads-up display. The elevation component of lead angle 151 passes through a linear blending device 154, the output of which is a blended elevation lead angle signal 156. The blending device 154 simply multiplies the elevation lead angle component 151 by a numeral which starts at a value of zero and changes linearly with time, reaching and maintaining a value of unity after a fixed time interval, the blend time. The sum of the differential pitch attitude 123 and blended elevation lead angle 156, that is, the output of summing device 186, establishes an elevation position 155 of the lead angle steering indicator in command aircraft coordinates with respect to the gunline of the command aircraft.

A traverse position 158 of the lead angle steering indicator is computed in much the same manner as the elevation position 155. One difference, however, is that the traverse lead angle 152 is corrected for an error which is intentionally introduced into the traverse steering indicator in order to improve steering. This display technique is described in detail hereinafter. A traverse correction factor 161 is subtracted from the traverse component of lead angle at a differencing device 164. The corrected traverse lead angle component 160 is blended, as in the case of the elevation component 151, using a linear blending device 159. The blended traverse component 184 of traverse lead angle is then added to the differential yaw attitude 143, computed in the command aircraft yaw model means 73, using a summing device 157 to obtain the final traverse position of the lead angle steering indicator.

The elevation position 155 and the traverse position 158 of the lead angle steering indicator in command aircraft coordinates are then processed for display. First, they are converted into components of a display vector in the horizontal and vertical directions of the heads-up display by a pair of tangent devices 165 and 166, respectively. The display vector is then transformed through several rotations and properly referenced for display in aircraft coordinates.

The first transformation in the display sequence is a clockwise rotation at 168 about the command aircraft gunline by an angle $\phi_D$, indicated by the numeral 167, $\phi_D$ being the lagged display angle. Pio diagrams (*IEEE, vol. ANE*-11, *pp.* 128–134, 1964) are used to represent rotational sequences. The lagged display angle $\phi_D$ is obtained from a first-order filter 185 having gain $\tau_1 K_1$ and a time constant $\tau_1$. The purpose of the lagged display angle $\phi_D$ is to provide some degree of dynamic space stabilization to the steering indicator. The filter 185 processes the roll rate command 94 from the command aircraft roll model means 71 in such a way that the output 167 of the filter 185 immediately equals the input 94 of the filter 185 multiplied by gain $K_1$. The output 167 thereafter decays to zero (in the absence of further inputs) with the decay rate established by time constant $\tau_1$.

After being rotated about the command aircraft's gunline by $\phi_D$ at 168, the display steering indicator is referenced to the command aircraft's velocity vector by the subtraction of the gun angle of attack, represented by the numeral 169 in FIG. 9, using a difference of tangents device 187 defined in FIG. 9*a*. The tangents of angles are used because the display components are being interpreted as vector distances on the heads-up display. The display is then rotated counterclockwise at 170 about the command aircraft's velocity vector by an amount equal to the differential roll attitude 96 between the command aircraft and the actual aircraft, which is computed in the command aircraft roll model means 71.

The combined clockwise rotation about the gunline and counterclockwise rotation about the velocity vector provides a stabilized elevation steering plane which moves in traverse either to the right or to the left depending upon the direction of the roll rate command 94. For example, if the target appears to the right of the steering indicator, the pilot will bank to the right causing a positive roll rate command. This will in turn establish a positive lagged display angle 167 and a positive differential roll attitude 96. Rotations 168 and 170 will cause the steering indicator to move to the right toward the target. This provides a useful steering cue to the pilot which has proved beneficial in improving traverse steering stability. However, it does introduce a temporary display error since the traverse position of the steering indicator has been changed even though the traverse component of lead angle has not changed correspondingly. The display error is temporary since both the lagged display angle 167 and the differential roll attitude 96 are reduced to zero after a short time, depending upon $\tau_1$ of the filter 185 and the gain of gain means 97, shown in FIG. 6.

During the interval that traverse steering indicator error persists, a correction factor 183 is computed using a correction factor computation means 163. The correction factor 183 is an input to a low pass filter means 162 which smooths the signal input. The output 161 of filter means 162 is subtracted from the traverse lead angle component 152 at the differencing device 164. Use of the correction factor 161 provides suitable accuracy in traverse for those circumstances of low frequency display error, while maintaining beneficial display dynamics during higher frequency steering situations.

After the lagged display angle rotation 168 and the differential roll attitude 170, the display vector is referenced to the aircraft's body axis by adding the effect of aircraft angle of attack 61 at a sum of tangents means 171. The display vector is then rotated from wind coordinates to body coordinates by first rotating through the sideslip angle 62 at a rotation means 172, and then through aircraft angle of attack 61 at a rotation means 173.

Finally, the display vector is referenced to the center of the heads-up display by adding the effects of a HUD elevation angle 174 using a sum of tangents means 175, and then rotated through the HUD elevation angle at a rotation means 176. A traverse steering indicator position 178 is determined from the second component 179 of the transformed display vector using a scaling gain means 177. An elevation steering indicator position 180 is determined from the third component 181 of the transformed display vector using a scaling gain means 182. The first component of the transformed display vector is not computed since it lies in the direction of the steering indicator and, therefore, does not affect the location of the steering indicator in the heads-up display field of view.

It can therefore be seen that means have been provided which provide a steering indicator for aerial gunnery purposes which displays the effect of pilot control action by simultaneously applying said control action to both the actual aircraft and a computer model, termed the command aircraft, having the desired response of the actual aircraft. Moreover, the steering indicator is referenced to the computer modeled aircraft, or command aircraft. This action provides idealized information to the pilot for timely assessment of his control action, thereby reducing the tendency for pilot-induced oscillation during precision steering. Means have also been provided for driving the computer modeled aircraft, or command aircraft, into coincidence with the actual aircraft using a feedback mechanization.

Figure 10:
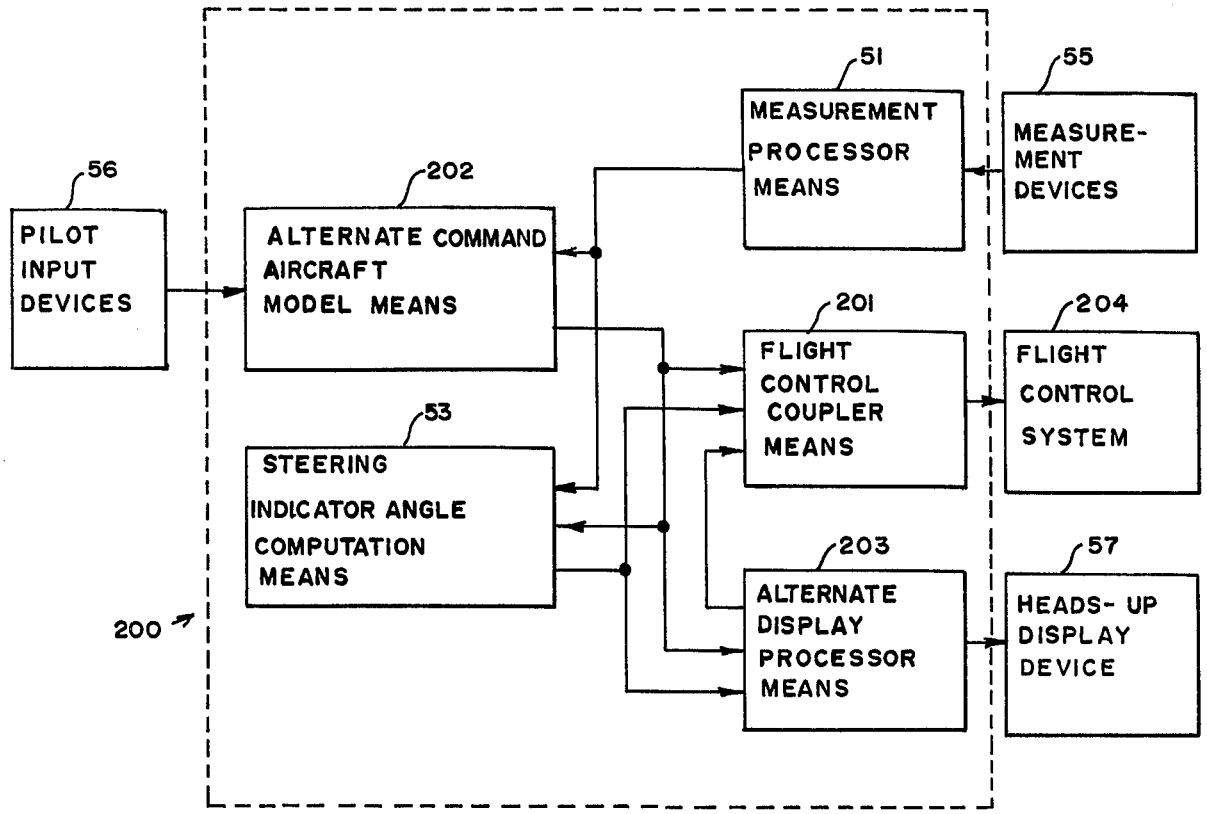
FIG. 10 is a block diagrammatic view of the essential operative portions of a second illustrative embodiment of multi-axis command aircraft sterring system embodiment of our invention.

The system 50 of our invention shown in FIGS. 4 through 9 provides for driving the command aircraft and the actual aircraft into coincidence by reorienting the command aircraft attitude to the actual aircraft attitude by feedback action in the command aircraft model means. An alternate embodiment of our invention, which was previously discussed using simplified single-axis description in conjunction with FIG. 3, provides for driving the command aircraft attitude and the actual aircraft attitude into coincidence by rotating the actual aircraft by means of coupling to the aircraft's flight control system. FIGS. 10, 11, and 12 show in greater detail the three-axis mechanization of this alternate embodiment. A steering system 200, shown generally in FIG. 10, in its basic structure is similar to that of the system 50 shown in FIG. 4. The two embodiments are similar except for the addition of flight control coupler means 201, and the designations of an alternate command aircraft model means 202 and an alternate display processor means 203. Like reference numbers for like component members are used, where appropriate.

The command aircraft model means 202 includes the command aircraft roll model means 71 of FIG. 6; the command aircraft pitch model means 72 of FIG. 7, and the command aircraft yaw model means 73 of FIG. 8, which are unchanged structurally. However, since the command aircraft attitude is not reoriented toward the actual aircraft attitude using feedback in the system 200, the values of gains provided by the gain means 97, 121, and 144 of FIGS. 6, 7, and 8, respectively, are altered significantly, depending upon the degree of coupling provided by the flight control coupler means 201. For example, in applications where the characteristics of the desired response established by command aircraft model means in an individual axis of control are closely matched by the flight control system and where the flight control coupler means 201 is given sufficient control authority relative to a conventional flight control system 204, the feedback gain is set to zero, and the gain means 97, 121, and 144 may be eliminated. In this event, the command aircraft and the actual aircraft are driven into coincidence solely by the rotation of the actual aircraft. On the other hand, other applications may make use of some feedback in conjunction with the flight control coupler means 201. In this latter case, the gains provided by the gain means 97, 121, and 144 may be adjusted accordingly.

The flight control coupler means 201 is best described with respect to FIG. 11. The coupler means 201 provides two principal functions. First, it combines differential attitude components and their rates from the command aircraft model means 202 into augmenting control signals for use in an aircraft flight control system 204. Second, it introduces the lead angle, as computed in the lead angle computer 153, into the display indirectly through the flight control system rather than directly into the display.

As shown in FIG. 11, the roll rate error signal 102, obtained from an output 70 of a summing device 79 shown in FIG. 6, is linearly combined with the differential roll attitude 96 between the command aircraft and the actual aircraft using gain means 205 and summing device 206. The output of summing device 206, a combined signal 207, is multiplied by gain means 208 to produce a roll rate correctional signal 209 in command aircraft coordinates.

The differential pitch attitude 123 between the command aircraft and the actual aircraft from the pitch model means 72 is differenced with a blended elevation component 212 of lead angle using a differencing means 214. The blended elevation component 212 is the output of a linear blending device 218 which has the same characteristics described in conjunction with blending devices 154 and 159 of FIG. 9. Blending device 218 receives the elevation lead angle signal 131 from the lead angle computer 153. The output of differencing means 214 is a difference 215 which is linearly combined with the pitch rate error signal 129. The pitch rate error signal 129 is obtained from an output 188 of a summing device 189 of the pitch model means 72 shown in FIG. 7. The pitch rate error 129 passes through a gain means 210 and is combined with the difference 215 at a summing device 211. The combined signal 216, that is, the output of summing device 211, is multiplied by the gain of a gain means 217 to produce a pitch rate correction signal 218 in command aircraft coordinates.

As in the pitch channel, the differential yaw attitude 143 between the command aircraft and the actual aircraft from the yaw model means 73 is differenced with a blended traverse component 219 of lead angle using a differencing means 220. The blended traverse component 219 is the output of a linear blending device 190 which has characteristics similar to those described in conjunction with the blending devices 154 and 159 of FIG. 9. Blending device 190 receives the traverse lead angle signal 132 from the lead angle computer 153. The output of differencing means 220 is combined with the traverse display correction signal 183, computed in the display processor means 203, at a summing device 191. The resulting signal 221 is linearly combined with the yaw rate error signal 149. The yaw rate error signal 149 is obtained from an output 192 of a summing device 193 of the yaw model means 73, shown in FIG. 8. The yaw rate error 149 passes through a gain means 222 and is combined with the signal 221 at a summing device 223. The combined signal 224 is multiplied by gain means 225 to produce a yaw rate correction signal 226 in command aircraft coordinates.

The roll rate correction signal 209, pitch rate correction signal 218, and yaw rate correction signal 226 are transformed from command aircraft coordinates to aircraft body coordinates by rotating through sideslip angle 62 and angle of attack 61, which are obtained from the measurement processor means 51. The individual transformed components are them scaled to match the flight control system's controlled variables, filtered, and limited. When used with an F-15 flight control system, for example, this requires conversion of the augmenting roll rate command into scaled degrees per second using gain means 227, and the passage of the signal through a filter means 236 and a roll limiter means 233 to obtain the roll coupler signal 230; the conversion of the augmenting pitch rate command into an equivalent, scaled normal acceleration command using measured airspeed 60 and a gain means 228, and the passage of the signal through a filter means 237 and a pitch limiter 234 to obtain the pitch coupler signal 231; and the conversion of the augmenting yaw rate command into an equivalent, scaled lateral acceleration command using measured airspeed 60 and a gain means 229, and the passage of the signal through a filter means 238 and a limiter 235 to obtain the yaw coupler signal 232. Filter time constants $\tau_1$, $\tau_2$, $\tau_3$ of filter means 236, 237, and 238, respectively, were selected to match corresponding pre-filter time constants in the F-15 flight control system. Other time constant selections may be required for other flight control systems. Each of the coupling signals is limited by the limiters 233, 234, and 235 to establish a proper blend in authority between direct pilot flight control inputs and the coupling signals from the command aircraft steering system.

The display processor means 203 is illustrated in FIG. 12. A comparison of FIG. 12 and FIG. 9 shows that the only difference between the processors 203 and 54 is the elimination of lead angle insertion in the display processor means 203. Since the elevation component 131 and the traverse component 132 are introduced into the flight control coupler means 201 pitch and yaw rate channels, respectively, the differential pitch attitude 123 and the differential yaw attitude 143 will include their respective lead angle components due to the closed loop action of the flight control coupler. This action was previously discussed in conjunction with FIG. 3.

It can be seen, therefore, that an alternate means has been provided for both driving the command aircraft and the actual aircraft into coincidence, and for indirectly establishing a lead angle steering indicator using direct coupling into the aircraft's flight control system. It is apparent further that additional configuration can be achieved by blending the features of the preferred and alternate embodiments described.

Numerous variations, within the scope of the appended claims, will be apparent to those skilled in the art in light of the foregoing description and accompanying drawings. Thus, other heretofore difficult aircraft control functions are much easier to accomplish with our invention. For example, terrain following becomes a relatively simple task because the pilot can observe the affect of his control actions much sooner. Non-piloted aircraft can be controlled by flying the command aircraft and conforming the action of the non-piloted aircraft to those of the command aircraft. Ground control approach systems using our invention will provide for the precise control of the incoming aircraft by the precision control of the computer generated command aircraft. The steering system of our invention can be used in conjunction with trainable guns to decrease the time required to arrive at a solution in aircraft gunnery applications and substantially reduce pilot aim wander. These variations are merely illustrative.

Having thus described the invention, what is claimed and desired to be secured by Letters Patent is:

1. A control device, comprising:

operator input means for initiating commands to control an object;

means responsive to said operator input means for operating on said object in accordance with commands imposed by said operator input means;

means for displaying a result of a command imposed by said operator means;

means for providing an idealized time-response model of said object, said idealized time-response model providing means being operatively connected to said operator input means and to said display means, said idealized time-response model means positioning said display means according to the effect of said operator commands on said idealized time-response model means, said idealized time-response model means acting directly on said display means to display the effect of said operator commands at least initially independently of the effect of said operator commands on said object so that said display means presents the reaction of said idealized model means to said operator commands; and means for correlating the positions of said idealized time-response model means and said object, said correlating means acting on said display means to eliminate real time steady state errors between said idealized time response model means and said object on said display means.

2. The control device of claim 1 wherein said object comprises an aircraft; said operator responsive means comprising a flight control system of said aircraft; said idealized time-response model means comprising roll model means, pitch model means, and yaw model means; said control device further including display processor means operatively connected between said roll, pitch, and yaw model means, and said display means; and lead angle computer means operatively connected to said display processor means for introducing lead angle computation directly into said display processor means.

3. The control device of claim 2 wherein said means for correlating the positions of said idealized time-response model means and said object comprises means for gradually bringing the position of said aircraft into coincidence with the position of said idealized model means, including feedback means for reducing the effect of said idealized time-response model means on said display means.

4. The control device of claim 3 further including means for introducing a traverse component of lead angle to the yaw model means of said idealized time-response model means.

5. The control device of claim 1 wherein said means for correlating the positions of said idealized time-response model means and said object comprises flight control coupler means for bringing the position of said aircraft into coincidence with the position of said idealized time-response model means.

6. The control device of claim 5 wherein said idealized time-response model means comprises roll model means, pitch model means, and yaw model means, said control device further comprising means for introducing a traverse correction lead angle component to the yaw model means of said idealized time-response model means.

7. The control device of claim 6 further including lead angle computer means, said lead angle computer means being operatively connected to said flight control coupler means.

8. In a steering system for an aircraft having a flight control system, display means for providing pilot steering information, and control means for commanding steering input commands to said flight control system, the improvement which comprises means for providing a command model aircraft, said command model aircraft receiving said steering input commands from a pilot of said aircraft, said command model having an output which operates said display means with reference to said command model, said command model acting to display the effect of said steering input commands at least initially independently of the effect of said steering input commands on said aircraft so that said display means presents the reaction of said command model to said steering input commands, and means for correlating the referenced display of said command model with the actual position of said aircraft, said correlating means reducing real time steady state errors between said command model and the actual position of said aircraft so that the display means presentation reflects the actual position of said aircraft.

9. The improvement of claim 8 wherein said correlating means comprises means for gradually bringing the position of said aircraft into coincidence with the position of said idealized model means, including feedback means for reducing the effect of said command model on said display means.

10. The improvement of claim 9 wherein said command model means comprises roll model means, pitch model means, and yaw model means, a display processor means operatively connected between said roll, pitch and yaw model means and said display means, and lead angle computer means operatively connected to said display processor means for introducing lead angle computation directly into said display processor means.

11. The improvement of claim 8 wherein said correlating means comprises flight control coupler means for aligning the position of said aircraft with the position of said command model.

12. The improvement of claim 11 wherein said command model means comprises roll model means, pitch model means, and yaw model means, said flight control coupler means including means for introducing a traverse component lead angle into the output of said yaw model means.

13. A method for controlling an object, comprising:
generating an idealized model of the object;
connecting a commanding control means for instituting control commands both to the object being controlled and to the idealized model of the object;
providing a display for displaying a result of a control command;
connecting said display to said idealized model so that the display shows the effect of the control command on the idealized model, the effect so displayed at least initially being independent of the effect of the control command on the object so that said display presents the reaction of said idealized model to the control command; and
correlating the state of the idealized model with the state of the object under control so that the real time steady state condition of the idealized model concurs with the real time steady state condition of the object under control.

14. The method of claim 13 wherein said correlating step further includes the step of reducing the effect of said idealized model on said display so that said display corresponds to the actual position of said object after some predetermined time period.

15. The method of claim 14 for use in an aircraft system, said aircraft system including means for computing lead angle, further including the step of introducing a lead angle representation directly into the display result of said control command.

16. The method of claim 15 wherein said lead angle introduction step further includes the step of providing a traverse component of lead angle, and computing a correction factor for the traverse component of lead angle during an initial time period after a control command.

17. The method of claim 13 wherein said correlating step further includes the step of conforming the state of said object to the state of said idealized model by bringing the real time condition of the object under control into agreement with the real time condition of the idealized model.

18. The method of claim 17 for use in an aircraft system, said aircraft system including means for computing lead angle and flight control means for controlling the position of said aircraft, further including the step of introducing the computed lead angle directly into said flight control system and indirectly into the resulting display observed by a pilot.

19. The method of claim 18 wherein said computed lead angle includes a traverse component and an elevation component, said idealized model including roll axis model means, pitch axis model means, and yaw axis model means, the traverse component of lead angle being combined with an output of said yaw model means.

20. A method for controlling an aircraft system, said aircraft system having control means, comprising:
generating an idealized model of the aircraft;
providing data from the idealized model aircraft to the pilot of the actual aircraft;
connecting a means for generating the idealized model to the aircraft control means so that commands of the pilot are reflected in the model and in the data provided to the pilot before they are reflected in the actual aircraft, the data provided to the pilot at least initially being independent of the effect of the commands of the pilot on the actual aircraft so that the pilot can observe the reaction of the commands on idealized model prior to the reaction of the commands on the actual aircraft; and
correlating the position of the idealized aircraft with the actual aircraft, said correlating means acting to reduce real time steady state errors between said idealized model and the position of said aircraft.

21. A control device for an aircraft, comprising:

operator input means for initiating commands to control said aircraft, said operator input means including a flight control system of said aircraft;

means responsive to said operator input means for operating on said aircraft in accordance with commands imposed by said operator input means;

means for displaying a result of command imposed by said operator input means;

means for providing an idealized time response model of said aircraft, said idealized time-response model providing means being operatively connected to said operator input means and to said display means, said idealized time-response model means positioning said display means according to the effect of said operator commands on said idealized time-response model means, said idealized time-response model means comprising roll model means, pitch model means, and yaw model means;

display processor means operatively connected between said roll, pitch and yaw model means and said display means;

lead angle computer means operatively connected to said display processor means for introducing lead angle computation directly into said display processor means;

means for introducing a traverse component of lead angle to the yaw model means of said idealized time-response model means; and means for correlating the positions of said idealized time-response model means and said aircraft, said correlating means including means for gradually bringing the position of said aircraft into coincidence with the position of said idealized model means, including feedback means for reducing the effect of said idealized timeresponse model means.

22. A control device, comprising:

operator input means for initiating commands to control an object;

means responsive to said operator input means for operating on said object in accordance with commands imposed by said operator input means;

means for displaying a result of a command imposed by said operator input means;

means for providing an idealized time-response model of said object, said idealized time-response model providing means being operatively connected to said operator input means and to said display means, said idealized time-response model means positioning said display means according to the effect of said operator commands on said idealized time-response model means, said idealized time-response model means including roll model means, pitch model means and yaw model means;

means for introducing a traverse correction lead angle component to the yaw model means of said idealized time-response model means; and means for correlating the positions of said idealized time-response model means and said object, said correlating means comprising flight control coupler means for bringing the position of said aircraft into coincidence with the position of said idealized time-response model means.

23. The control device of claim 22 including lead angle computer means, said lead angle computer means being operatively connected to said flight control coupler means.

* * * * *

UNITED STATES PATENT AND TRADEMARK OFFICE

CERTIFICATE OF CORRECTION

PATENT NO. : 4,092,716

DATED : May 30, 1978

INVENTOR(S) : Robert L. Berg and William J. Murphy

It is certified that error appears in the above-identified patent and that said Letters Patent are hereby corrected as shown below:

Abstract, lines 7 and 8, delete "to the operator in a manner which dynamically decouples the display".

Column 8, line 61, "indictor" should be "indicator".

Column 10, line 13, "strim" should be "trim".

Column 10, line 38, "gate" should be "rate".

Column 22, line 3, "timeresponse" should be "time-response".

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*